US005421749A

United States Patent [19]

Schrauder

[11] Patent Number: 5,421,749

[45] Date of Patent: Jun. 6, 1995

[54] SCREWLESS SPRING CLIP

[75] Inventor: Franz Schrauder, Litzendorf, Germany

[73] Assignee: F. Wieland Elektrische Industrie GmbH, Bamberg, Germany

[21] Appl. No.: 63,394

[22] Filed: May 18, 1993

[30] Foreign Application Priority Data

May 22, 1992 [DE] Germany ..... 42 16 927.5

[51] Int. Cl.[6] ..... H01R 4/46

[52] U.S. Cl. ..... 439/786; 439/835; 439/729

[58] Field of Search ..... 439/725, 729, 786, 775, 439/835–837, 816

[56] References Cited

U.S. PATENT DOCUMENTS 2,027,220 1/1936 Benson ..... 439/786
4,006,960 2/1977 Lacan ..... 439/786 X

FOREIGN PATENT DOCUMENTS 0432272 8/1926 Germany .
3727091 2/1989 Germany .
5-129039 5/1993 Japan .

*Primary Examiner*—Khiem Nguyen
*Attorney, Agent, or Firm*—Jordan and Hamburg

[57] ABSTRACT

A screwless spring clip for use with a bus bar, includes a binding clip for holding a conductor to the bus bar, the binding clip having a transverse opening, and a large opening through which the bus bar and the conductor extend, such that when the binding clip is tensioned against the bus bar, the bus bar is in contact with the conductor; and a leaf spring for tensioning the binding clip against the bus bar, the leaf spring being connected to the bus bar and being connectable in a tensioned state to the binding clip by a control element such that the leaf spring is locked to the binding clip in the tensioned state, the leaf spring having one leg secured to the bus bar and an opposite free leg adapted to be hooked into the transverse opening of the binding clip.

12 Claims, 2 Drawing Sheets

SCREWLESS SPRING CLIP

BACKGROUND OF THE INVENTION

The invention relates to a screwless spring clip with a binding clip, which is tensioned against a bus bar by a spring that can be released by a control element, particularly for installation in an insulated housing.

For all clips, including screwless spring clips, it is very frequently desirable that clips be delivered in the open state, so that the assembler does not first have to open the clamp in order to insert the conductor. Instead, it generally suffices to insert the conductor and then to release the spring by means of a control element, so that it can draw the binding clip into the clamping position, at which it clamps the conductor. Supplying the screwless clip in the open state requires, however, that the clamping spring be prestressed highly against its own clamping force and kept in this state in the warehouse of the manufacturer, the wholesaler or the user. However, with increasing residence time (in the extreme case, up to a few years) of the opened clamp with the pre-stressed spring in the different warehouses, the danger increases that the clamping force of the clamping spring abates and that the clip then no longer functions adequately when used, because it no longer can exert the necessary clamping force.

SUMMARY OF THE INVENTION

It is therefore an object of the invention to develop a screwless spring clip that can be delivered in the open position without having to pretension the clamping spring.

Pursuant to the invention, this objective is accomplished by constructing and disposing the spring in such a manner that it is brought by a control element into the tensioned position and locked there, together with the binding clip. Preferably, the spring is a leaf spring, which is fastened with one leg to the bus bar and the free leg of which can be hooked into the binding clip.

Due to the inventive construction, the clip, on the one hand, can be supplied in the open state, since the spring is not yet connected with the binding clip and thus does not draw it into the closed position. The spring clip can be kept in the open position either by a clamping friction of the bus bar in the opening of the binding clip forming the clamping space or by appropriate locking cams on the binding clip, which counteract any independent, easy shifting of the binding clip on the bus bar. The force of the clamping spring is then, in any case, dimensioned so that it can readily cancel this slight locking. On the other hand, the spring is in the tension-free position before the first use of the clip, so that an abatement as in the case of the screwless clips supplied in the pretensioned state, can also take place. Nevertheless, the arrangement is not more complicated than conventional arrangements with controlling elements, since it is merely necessary in the described, preferred embodiment to depress the free leg of the spring either with the help of a special key in the insulated housing or with the help of a screwdriver or the like, in order, on the one hand, to tension the spring, and, at the same time to hook it into the binding clip. Hooking-in the spring can take place by a sideways sliding down along a hook-shaped part of the binding clip, so that the spring is then compressed under the hook after the free leg of the spring is depressed. On the other hand, it may be preferred to engage the free leg in a transverse opening of the binding clip.

In order to achieve improved contacting of the conductor, two binding clips, forming clamping sites some distance apart for a conductor, are provided in a modified embodiment of the present invention. The hooking-in ends of the binding clip, disposed on the side opposite from the contacting side for the conductors, are bent against one another and lie essentially in one plane. In the simplest embodiment of this version with two binding clips, the hooking-in ends with aligned openings can be connected with one another, preferably in such a manner that the two binding clips are formed from a common bent sheet metal part, If necessary, the bus bar can be provided additionally between the binding clips with a contact projection on the side opposite from the hooking-in ends. However, in order to achieve secure clamping of the conductor by each of the two binding clips, the free leg of the leaf spring can be forked so that each of the two forked ends engages an opening of one of the adjacent booking-in ends of the separate binding clips, wherein the two binding clips can act independently of one another.

BRIEF DESCRIPTION OF THE DRAWING

Further advantages, distinguishing features and details of the invention arise out of the following description of some embodiments, as well as from the drawing, in which.

DESCRIPTION OF THE PREFERRED EMBODIMENTS

Figure 1:
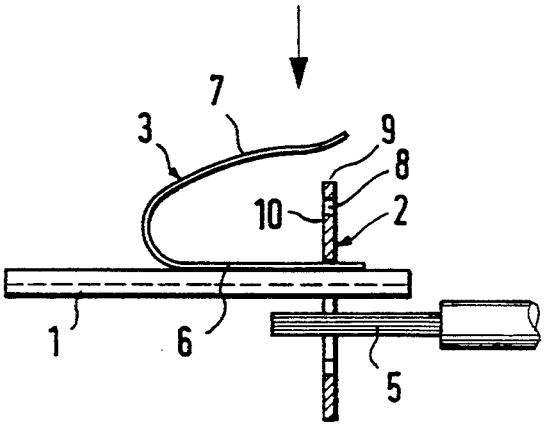
FIG. 1 shows a section through a diagrammatic representation of a screwless spring clip according to the simplest embodiment of the present invention.
Figure 2:
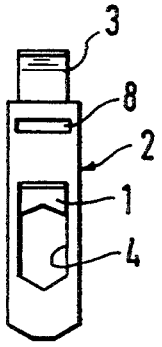
FIG. 2 shows a right side elevational view of the clip of FIG. 1.

For the screwless spring clip shown diagrammatically in FIGS. 1 and 2, the bus bar 1 is encompassed by a binding clip 2, which can be pulled up by a leaf spring 3. Accordingly, a conductor 5, pushed into the opening 4 of the binding clip 2 which encompasses the bus bar 1, can be pressed against the underside of the bus bar 1 so as to make contact therewith. Pursuant to the invention, the leaf spring 3 is constructed and disposed with its lower fastening leg 6 on the bus bar 1 so that, when the free leg 7 is depressed with the help of a controlling element, for example, a screw driver or a control key in the clip housing, the spring 3 suspends itself in a tensioned position in a transverse opening 8 of the binding clip 2. Accordingly, when the controlling element is let go, spring 3 pulls up the binding clip 2' immediately into the clamping position. At the same time, the end of the free leg 7, when depressed, initially slides down along the upper edge 9 of the hooking-in end 10 of the binding clip 2 disposed above bus bar 1, that is, on the side of the bus bar 1 opposite from the conductor 5, until the opening 8 is reached, whereupon the end of the free leg 7 necessarily hooks immediately into this opening 8.

Figure 3:
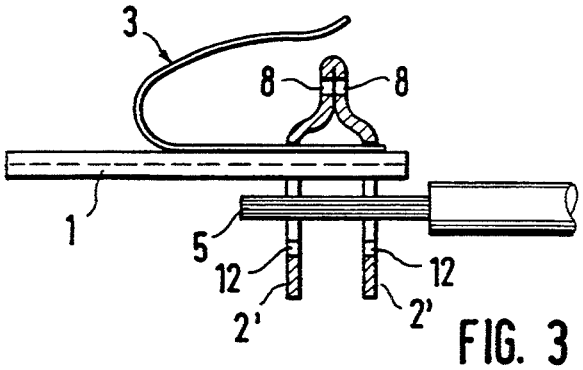
FIG. 3 shows a section through another embodiment of the present invention, with two binding clips connected with one another.

In order to provide a better contact, two binding clips 2' are provided in the embodiment of FIG. 3. The upper control ends of binding clips 2' are bent towards and connected with one another, so that their openings 8 are aligned with one another. In the embodiment shown, two actually separate binding clips 2' are not subsequently connected with one another, for example, by soldering or the like, although this would of course be possible; instead, the two binding clips 2' are parts of a common bent sheet metal part.

The consecutive arrangement of the two clamping sites furthermore prevents the conductor 5, particularly if it is a single-wire conductor, from being swivelled easily about its axis in the clamping site and the conductor from being moved in the clamping site.

Figure 4:
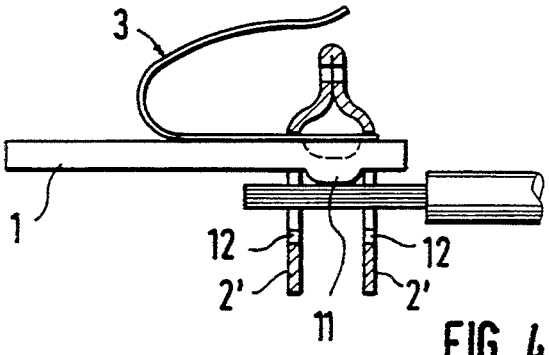
FIG. 4 shows a section, similar to that of FIG. 3, through a third embodiment of a screwless spring clip according to the present invention.

For the embodiment of FIG. 4, the bus bar 1 between the two binding clips 2' is provided with a contact projection 11, which is directed downwards, that is, to the side on which the conductor is introduced, and which ensures that even conductors which have an irregular thickness or are introduced in a tilted fashion, can make contact with edge 12 of the opening 4.

Figure 5:
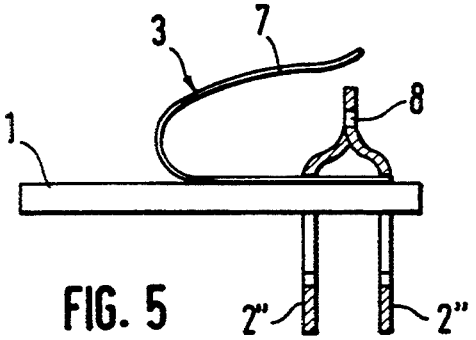
FIG. 5 shows a section through a fourth embodiment of a screwless spring clip according to the present invention, with separately controllable binding clips, which can act independently of one another.
Figure 6:
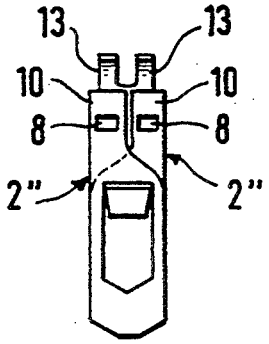
FIG. 6 shows an right side elevational view of the clip of FIG. 5.
Figure 7:
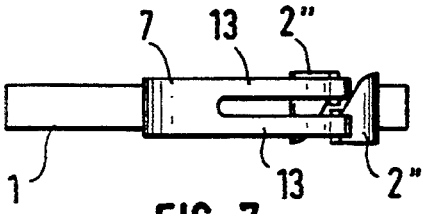
FIG. 7 shows a top plan view of the clip of FIG. 5.

Such reliable contacting of the two contact clips 2'' is ensured for the embodiments shown in FIGS. 5 to 7 due to the fact that the two binding clips 2'' are completely separate and independently acting parts, the upper hooking-in ends 10 of which are narrowed, so that they can be disposed next to one another in the same plane, and their openings 8 each can take up one of the forked ends 13 of the forked free leg 7 of the leaf spring 3.

Figure 8:
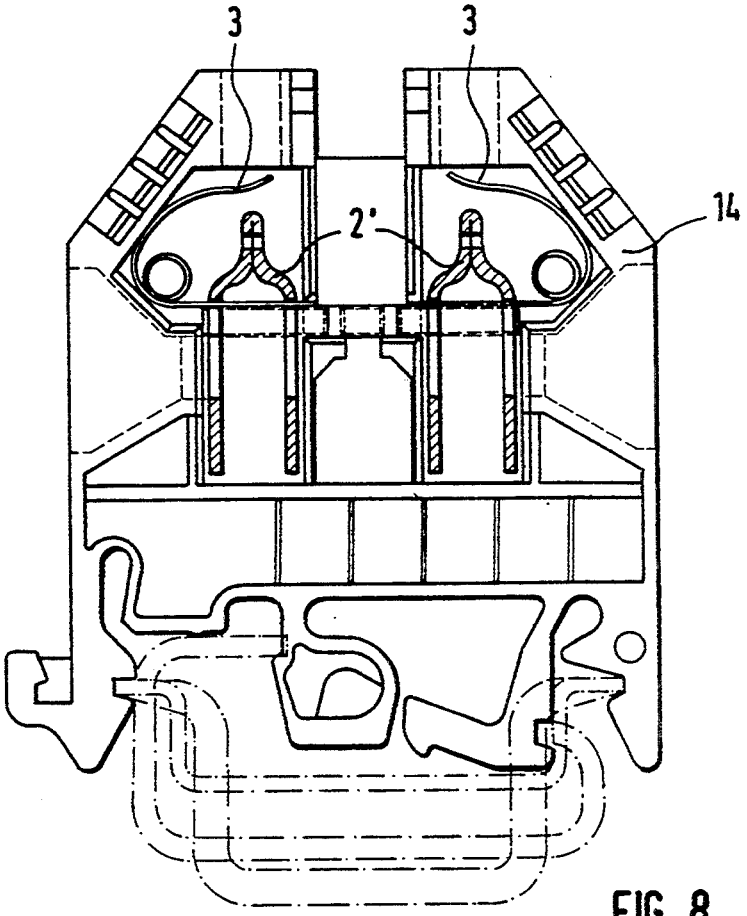
FIG. 8 shows a view of a series clip, which can be set on carrier rails, with two screwless spring clips disposed in an insulated housing.

Finally, in FIG. 8, an electrical series clamp, which can be placed on bus bars is shown. For this electrical series clamp, two inventive screwless screw clips similar to the embodiment of FIG. 3 are built into an insulated housing 14.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A screwless spring clip for use with a bus bar, said spring clip comprising:

binding clip means for holding a conductor to the bus bar, said binding clip means including:

at least one transverse opening, and a large opening through which the bus bar and the conductor extend, such that when said binding clip means is tensioned against the bus bar, the bus bar is in contact with the conductor; and spring means for tensioning said binding clip means against the bus bar, said spring means being connected to said bus bar and being connectable in a tensioned state to said binding clip means by a control element such that said spring means is locked to the binding clip means in said tensioned state, said spring means including a leaf spring having one leg secured to the bus bar and an opposite free leg adapted to be hooked into the at least one transverse opening of said binding clip means.

2. The screwless spring clip of claim 1, wherein said binding clip means includes two binding clips which form spaced-apart clamping sites for the conductor, said two binding clips having respective hooking-in ends which are bent against each another.

3. The screwless spring clip of claim 2, wherein the hooking-in ends of said two binding clips having aligned transverse openings which are adjacent to and connected with one another.

4. The screwless spring clip of claim 3, wherein said binding clip means includes a common sheet metal part which is bent to form said two binding clips.

5. The screwless spring clip of claim 3, wherein the hooking-in ends of said two binding clips extend to one side of the bus bar, and the bus bar includes contact projection means on a side thereof opposite said one side, for ensuring contact between the conductor and the bus bar.

6. The screwless spring clip of claim 1, wherein said binding clip means includes two binding clips which form spaced-apart clamping sites for the conductor, said two binding clips having respective hooking-in ends which lie adjacent to each other so as to be essentially co-planar, each hooking-in end having a transverse opening, and the spring means includes a leaf spring having one leg secured to the bus bar and a free leg adapted to be hooked into the binding clip means, said free leg being forked so as to provide two forked ends, each forked end adapted to be hooked into the opening in one of said hooking-in ends.

7. A screwless spring clip for use with a bus bar, said spring clip comprising:

binding clip means for holding a conductor to the bus bar, and spring means for tensioning said binding clip means against the bus bar, said spring means being connected to said bus bar and being connectable in a tensioned state to said binding clip means by a control element such that said spring means is locked to the binding clip means in said tensioned state, said spring means including a leaf spring having one leg secured to the bus bar and an opposite free leg adapted to be hooked into the binding clip means, said binding clip means including at least one transverse opening for receiving the free leg of said spring means in said tensioned state.

8. A screwless spring clip for use with a bus bar, said spring clip comprising:

binding clip means for holding a conductor to the bus bar, and spring means for tensioning said binding clip means against the bus bar, said spring means being connected to said bus bar and being connectable in a tensioned state to a said binding clip means by a control element such that said spring means is locked to the binding clip means in said tensioned state, said binding clip means including two binding clips which form spaced-apart clamping sites for the conductor, said two binding clips having respective hooking-in ends which are bent against each another and each binding clip being engageable with said spring means.

9. The screwless spring clip of claim 8, wherein the hooking-in ends of said two binding clips having aligned transverse openings which are adjacent to and connected with one another.

10. The screwless spring clip of claim 9, wherein said binding clip means includes a common sheet metal part which is bent to form said two binding clips.

11. The screwless spring clip of claim 9, wherein the hooking-in ends of said two binding clips extend to one side of the bus bar, and the bus bar includes contact projection means on a side thereof opposite said one side for ensuring contact between the conductor and the bus bar.

12. A screwless spring clip for use with a bus bar, said spring clip comprising:

binding clip means for holding a conductor to the bus bar, and spring means for tensioning said binding clip means against the bus bar, said spring means being connected to said bus bar and being connectable in a tensioned state to said binding clip means by a control element such that said spring means is locked to the binding clip means in said tensioned state, said binding clip means including two binding clips which form spaced-apart clamping sites for the conductor, said two binding clips having respective hooking-in ends which lie adjacent to each other so as to be essentially co-planar, each hooking-in end having a transverse opening, and the spring means includes a leaf spring having one leg secured to the bus bar and a free leg adapted to be hooked into the binding clip means, said free leg being forked so as to provide two forked ends, each forked end adapted to be hooked into the opening in one of said hooking-in ends.

* * * * *